US012329197B2

(12) United States Patent
Yan et al.

(10) Patent No.: US 12,329,197 B2
(45) Date of Patent: Jun. 17, 2025

(54) ELECTRONIC SMOKING DEVICE ACCOMMODATING GENERIC CIGARETTES

(71) Applicants: Kai Yan, Shenzhen (CN); Binlun Yan, Shenzhen (CN); Yanyilun Zhi, Shenzhen (CN)

(72) Inventors: Kai Yan, Shenzhen (CN); Binlun Yan, Shenzhen (CN); Yanyilun Zhi, Shenzhen (CN)

( * ) Notice: Subject to any disclaimer, the term of this patent is extended or adjusted under 35 U.S.C. 154(b) by 373 days.

(21) Appl. No.: 17/978,476

(22) Filed: Nov. 1, 2022

(65) Prior Publication Data

US 2023/0225406 A1 Jul. 20, 2023

(30) Foreign Application Priority Data

Jan. 17, 2022 (CN) ..... 202210052815.9
Jan. 17, 2022 (CN) ..... 202220121009.8

(51) Int. Cl.

| | |
|---|---|
| ***A24F 40/40*** | (2020.01) |
| ***A24F 40/20*** | (2020.01) |
| ***A24F 40/46*** | (2020.01) |
| ***A24F 47/00*** | (2020.01) |
| *A24F 40/57* | (2020.01) |
| *A24F 40/60* | (2020.01) |

(52) U.S. Cl.

CPC ..... *A24F 40/40* (2020.01); *A24F 40/20* (2020.01); *A24F 40/46* (2020.01); *A24F 47/00* (2013.01); *A24F 40/57* (2020.01); *A24F 40/60* (2020.01)

(58) Field of Classification Search

None

See application file for complete search history.

(56) References Cited

U.S. PATENT DOCUMENTS

| | | | | |
|---|---|---|---|---|
| 2017/0367404 | A1* | 12/2017 | Li | H05B 1/0244 |
| 2019/0297942 | A1* | 10/2019 | Kang | A24C 1/04 |
| 2021/0093009 | A1* | 4/2021 | Park | H05B 6/108 |
| 2023/0033800 | A1* | 2/2023 | Ferrie | A24F 40/85 |
| 2024/0114961 | A1* | 4/2024 | Campbell | A24F 40/20 |

FOREIGN PATENT DOCUMENTS

| | | | | |
|---|---|---|---|---|
| CN | 104664597 A | * | 6/2015 | A24F 13/00 |
| CN | 111150119 A | * | 5/2020 | A24F 47/00 |
| WO | WO-2021053119 A1 | * | 3/2021 | A24F 40/85 |

OTHER PUBLICATIONS

Translation of CN 104664597 A (Year: 2015).*
Translation of CN 111150119 A (Year: 2020).*

* cited by examiner

*Primary Examiner* — Michael H. Wilson
*Assistant Examiner* — Michael Patrick Mullen
(74) *Attorney, Agent, or Firm* — Yuan Qing Jiang

(57) ABSTRACT

Provided is an electronic smoking device accommodating a generic cigarette for generating less harmful aerosol and improving smoking flavor and quality. The electronic device comprises a cylindrical cigarette receiver, an extractor for retrieving smoking substances from cigarettes, a heating unit for baking the smoking substances instead of burning the substance, an air tight aerosol accumulation cavity to collect the vapor for a user to smoke, an electronic control circuit board and a power supply.

16 Claims, 11 Drawing Sheets

PRIOR ART

800

ELECTRONIC SMOKING DEVICE ACCOMMODATING GENERIC CIGARETTES

CROSS-REFERENCE TO RELATED APPLICATIONS

This application claims priority to Chinese Patent Application No. CN202220121009.8 filed on Jan. 17, 2022, and Chinese Patent Application No. CN202210052815.9 filed on Jan. 17, 2022, the entire contents of which are hereby incorporated by reference.

FIELD OF INVENTION

The present invention relates to an electronic smoking device, and finds particular application in connection with an electronic smoking device accommodating generic cigarettes and will be described with particular reference thereto. It is to be understood, however, that it also finds application in other usage scenarios, and is not necessarily limited to the aforementioned exemplary embodiment.

BACKGROUND OF THE INVENTION

Smoking is a proven hazard to both personal and public health. Smoking generates harmful substances such as tar, nitric oxide and carbon monoxide, some of them are cancer causing substances. While many people stop smoking as the result of long-time educational campaign to reduce the smoking population, for those who have difficulties to quit, low risk cigarettes have been developed to protect them by mitigating the harmful substances.

It has been recognized that most health hazard chemicals are produced at a high temperature (doi: 10.1183/20734735.ELF161) Physically, smoke is a stable aerosol composed of heterogeneous mixture of gases, vapors, liquid and particles. Referring to FIG. 1, the temperature in the tip section 110 of a typical cigarette 100 can reach 900° C., and the temperature drops to about 700° C. in the next section 120. Although the temperature continuously drops from 600° C. to 200° C. in a distillation zone 130, hazard chemicals in the aerosol generated at the high temperature section 110 and 120 can be inhaled by smokers. For this reason, there have been attempts in recent decades to reduce aerosol generating temperature with heat-not-burn method, therefore the level of the harmful chemicals in the aerosol is reduced with tobacco consumption devices.

A number of aerosol-generating devices with a reduced temperature for cigarette smoking are known. For example, Philip Morris International developed heat-not-burn cigarettes under IQOS brand (U.S. Pat. No. 11,191,300). The method of heat-not-burn is to heat tobacco material without setting it alight. At a temperature well below 900° C., heat-not-burn can generate a flavorful nicotine-containing aerosol containing less harmful chemicals compared with a regular cigarette. However, IQOS smoking device consumes certain brands, which are specially designed cigarettes. Smokers cannot freely choose the cigarettes available on the market.

In order to provide smokers with an electronic aerosol generating device that is compatible with generic cigarettes on the consumer market, Shenzhen Yukan Technology Co. developed IUOC (US 2018/0289073) and Shenzhen Youme Group Co., Ltd. developed YOUME (U.S. Pat. No. 10,786,009) for generic cigarettes to produce aerosol by means of heat-not-burn. However, with these devices, the entire cigarette including wrapping paper (FIG. 1, 150) is heated, creating charcoal smell from the baked paper.

SUMMARY OF THE INVENTION

According to an aspect of the present disclosure, an electronic smoking device accommodating generic cigarettes without baking the wrapping paper of the cigarette is provided. The electronic smoking device comprises a cylindrical cigarette receiver; an extractor for retrieving smoking substances from a cigarette; a heating unit including at least one heating element for baking the retrieved smoking substances to generate a desired aerosol; an air tight aerosol accumulation cavity with a first opening coupled to the cigarette receiver and a second opening coupled to the heating unit; an electronic control circuit board and a power supply.

In accordance with another aspect of the present disclosure, an electronic smoking device may include a cylindrical cigarette receiver, an extractor, a heating unit, an air tight aerosol accumulation cavity, an electronic control circuit board and a power supply. The extractor comprises an elongated portion being substantially disposed inside the cigarette receiver; said elongated portion comprising a tip, a body and a shank; the shank being connected to an electrical motor; said body providing means for extracting smoking substances from a cigarette. The heating unit may include at least one heating element for baking the extracted smoking substances to generate desired aerosol. The air tight aerosol accumulation cavity with a first opening air tightly coupled to the cigarette receiver and a second opening air tightly coupled to the heating unit.

In accordance with another aspect of the present disclosure, an electronic smoking device may include a cylindrical cigarette receiver, an extractor, a heating unit, an air tight aerosol accumulation cavity, an electronic control circuit board and a power supply. The extractor may include a body comprising a pair of a carving ridge and a flute having a downward angle and helically wrapped around the shank to facilitate retrieving the smoking substances and transferring them downward out of the cigarette.

In accordance with another aspect of the present disclosure, an electronic smoking device may include a cylindrical cigarette receiver, an extractor, a heating unit, an air tight aerosol accumulation cavity, an electronic control circuit board and a power supply. The heating unit includes an inlet and an outlet. Said inlet, having an operable lid, air tightly couples to the air tight aerosol accumulation cavity. Said lid allows feeding retrieved smoking substances when the lid is opened. The lid also prevents the smoking substances from being spilled out when it is closed. Said outlet is placed on the bottom of the device having an operable lid for disposing used materials. In one embodiment, the lid of the inlet has through holes to allow aerosol generated from the heating unit to be transferred to the air tight accumulation cavity and the lid of the outlet has through holes for air supply to the heating unit.

In accordance with another aspect of the present disclosure, an electronic smoking device may include a cylindrical cigarette receiver, an extractor, a heating unit, an air tight aerosol accumulation cavity, an electronic control circuit board and a power supply. The air tight aerosol accumulation cavity may have a first opening air tightly coupled to the cigarette receiver and a second opening air tightly coupled to the heating unit. The heating unit is detachably attached to the second opening of the aerosol accumulation cavity; said heating unit has one opening with a lid for feeding the retrieved smoking substances to the heating unit when the heating unit is attached to the air tight aerosol accumulation cavity; said opening allows for disposing used smoking substances when the heating unit is detached from the aerosol accumulation cavity.

BRIEF DESCRIPTION OF DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION OF THE INVENTION

Figure 1:
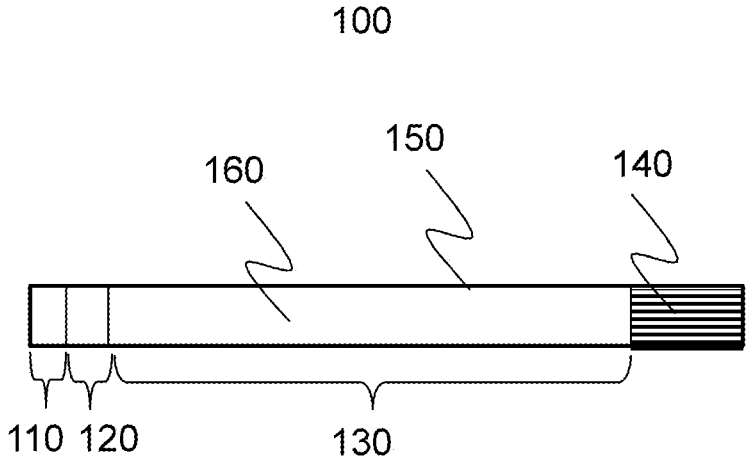
FIG. 1 is a prior art of a typical cigarette.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one ordinary skill in the art and having possession of this disclosure, are to be considered within the scope of the invention.

One objective of the present invention is to provide a heat-not-burn smoking device which is capable of accommodating a generic cigarette for consuming smoking substance without heating up its packing paper. As shown in FIG. 1, a typical generic cigarette 100 is formed by a packing paper 150 cylindrically wrapped a smoking substance 160. The diameter of a generic cigarette is in a range of 3 mm to 8 mm. The length of a typical cigarette is 70 mm-120 mm. One example of the smoking substances is tobacco in forms of flakes, strings, and shreds. The smoking substance may also include additives for flavors or other functions. A generic cigarette includes a filter 140 which is typically located at one end of the cigarette as a mouthpiece.

Figure 2:
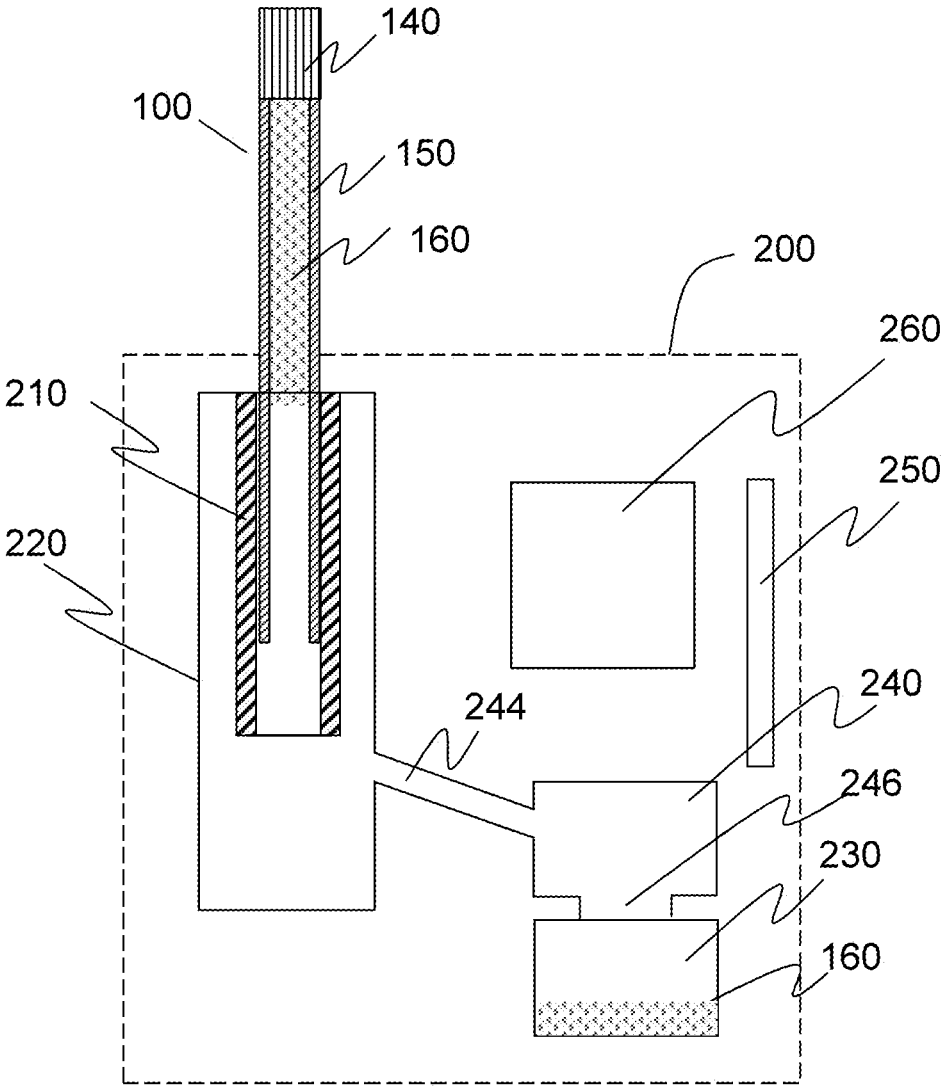
FIG. 2 illustrates a cross section view of an electronic smoking device according to one of the embodiments of the present disclosure.

FIG. 2 illustrates a cross section view of an electronic smoking device 200 according to one of the embodiments of the present disclosure. The smoking device comprises a cylindrical cigarette receiver 210, an extractor 220 for retrieving smoking substances from a cigarette, a heating unit 230 including at least one heating element for baking the retrieved smoking substances to generate a desired aerosol, an air tight aerosol accumulation cavity 240 having a first opening 244 air tightly coupled with the cigarette receiver and a second opening 246 air tightly coupled with the heating unit 230, an electronic control circuit board 250 and a power supply 260. The term "air tight aerosol accumulation cavity", as used here, refers to a cavity or an enclosure that is air tight and capable to contain aerosol without substantial leak when its openings are all sealed.

With continued reference to FIG. 2, when a generic cigarette 100 is inserted in the cigarette receiver 210, the extractor 220 extracts smoking substances 160, leaving the wrapping paper 150 behind intact. The retrieved smoking substance is transferred into the heating unit 230 via the air tight aerosol accumulation cavity 240. The smoking substance 160 in the heating unit is baked at a low temperature (<300° C.), generating smoking aerosol which is collected in the air tight aerosol accumulation cavity. A user draws on the mouthpiece with filter 140. Since the aerosol is generated from a low temperature by baking smoking substances only, without heating the cigarette wrapping paper 150, the aerosol maintains original flavors of the smoking substances.

Figure 3A:
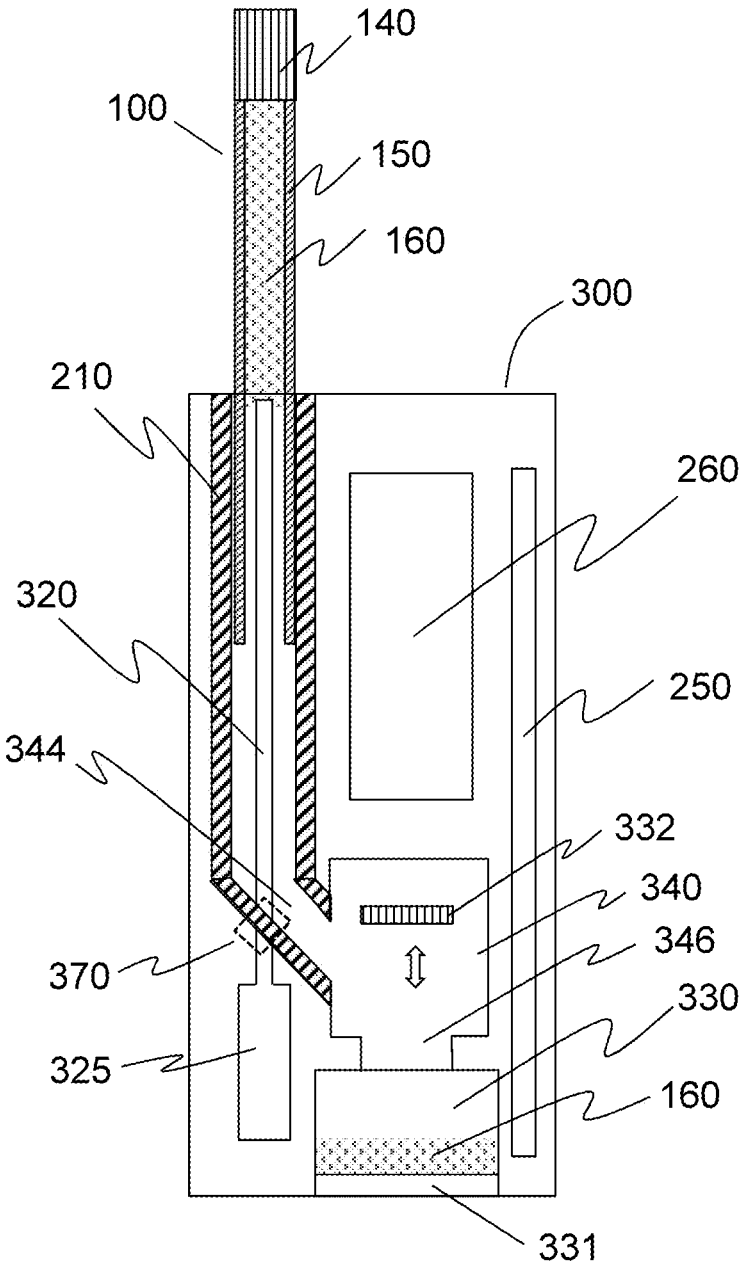
FIGS. 3A and 3B show the cross section views of an electronic smoking device according to one of the embodiments of the present disclosure.
Figure 3B:
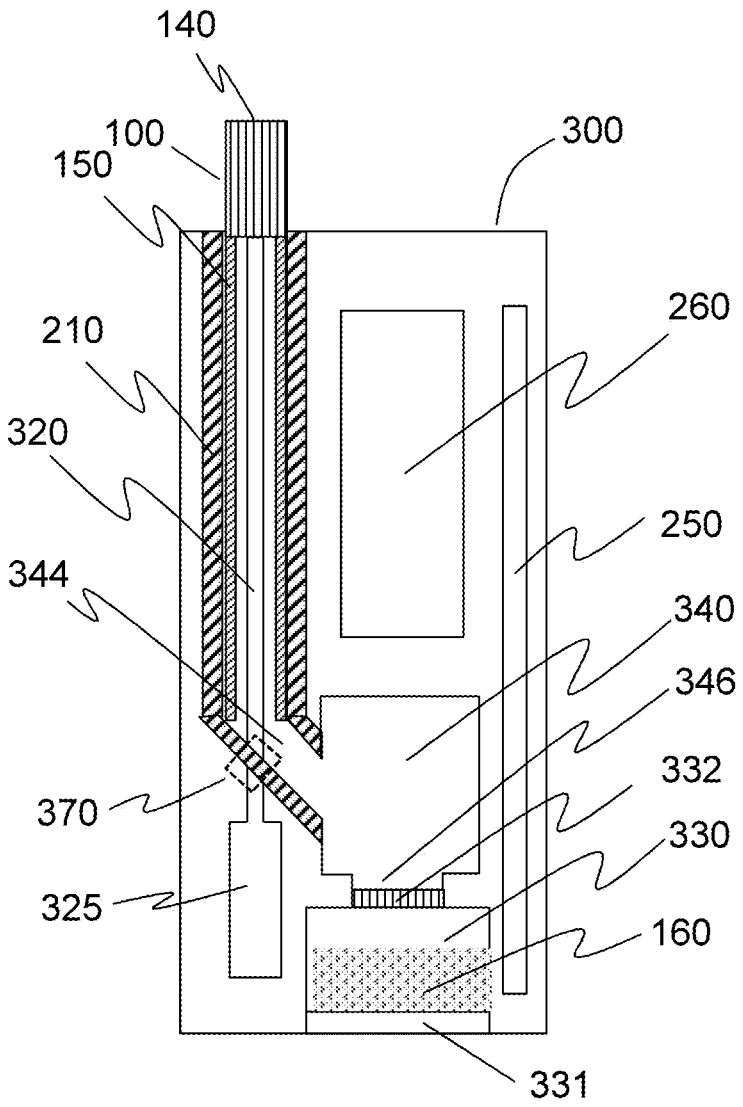

FIG. 3A and FIG. 3B illustrate an electronic smoking device 300 according to one of the embodiments of the present disclosure. The smoking device 300 comprises an extractor with an elongated portion 320 attached to a driver 325. As shown in FIG. 3A, a substantial portion of the elongated portion 320 is inside of the cigarette receiver. The elongated portion is engaged by the driver 325 to perform a motion pattern to agitate and to extract the smoking substance 160 from a cigarette. In one embodiment, the driver 325 is an electrical motor. The motion pattern for the elongated portion can be rotation around or longitudinal motion along the main axis.

The motion pattern can be also vibration, wobbling, or combination of all above. Once a cigarette is inserted all the way into the receiver and the smoking substance 160 is fully extracted out of the cigarette and loaded into heating unit 330, as shown in FIG. 3B. A user draws on the mouthpiece with filter 140 to inhale the aerosol collected in the air tight aerosol accumulation cavity. The empty cigarette with the wrapping paper 150 and filter 140 is disposable.

With continued reference to FIGS. 3A and 3B, an air tight aerosol accumulation cavity 340 has a first opening 344 and second opening 346. The cigarette receiver 210 is air tightly coupled with the first opening which has a slope. The angle between the slope and the main axis of the receiver is larger than 135° to facilitate transferring the retrieved smoking substance from the cigarette to the heating unit via the air tight aerosol accumulation cavity. The second opening 346 is air tightly coupled to the heating unit. Since the heat-not-burn smoking means requires a low baking temperature to reduce the level of harmful chemicals, the aerosol generating rate is generally low. Therefore it is necessary to have an air tightly coupling between the first opening of the air tight aerosol accumulation cavity 340 and the cigarette receiver, as well as an air tightly coupling between the second opening of the cavity 340 and the heating unit to ensure an optimum collection of the aerosol for a user to inhale. In addition, the air tight aerosol accumulation cavity 340 may include certain mechanical and/or electrical feed through structures, and these structures are required to be air tight. For example, the driver 325 is coupled to the elongated portion 320 of the extractor via an air tight mechanical feed through 370 of the aerosol accumulation cavity 340. The term "air tight aerosol accumulation cavity" is defined above. The air tight aerosol accumulation cavity 340 or 240 can be constructed as one piece without seam, or the cavity can be made by integrating several pieces together with air tight seals.

As shown in FIGS. 3A and 3B, the heating unit 330 includes an inlet air tightly connecting to the second opening 346 of the air tight aerosol accumulation cavity. Said inlet has an operable lid 332. When the lid is open, as shown in FIG. 3A, the retrieved smoking substances are fed into the heating unit. During baking process, lid 332 is closed to prevent the smoking substances from spilled out of the heating unit, as shown in FIG. 3B, especially when the device is off the vertical orientation. Said lid has a plurality of through holes to allow aerosol generated from the heating unit to be transferred to the air tight accumulation cavity. The heating unit also includes an outlet on the bottom of the device with an operable lid 331 for disposing used materials. Said lid has a plurality of through holes for air supply to the heating unit. In another embodiment, the through holes for passing generated aerosol to the aerosol accumulation cavity can be disposed on any location between the heating unit and the air tight aerosol accumulation cavity. Likewise, the through holes for air supply can be disposed on any location on the bottom of the heating unit.

Figure 4A:
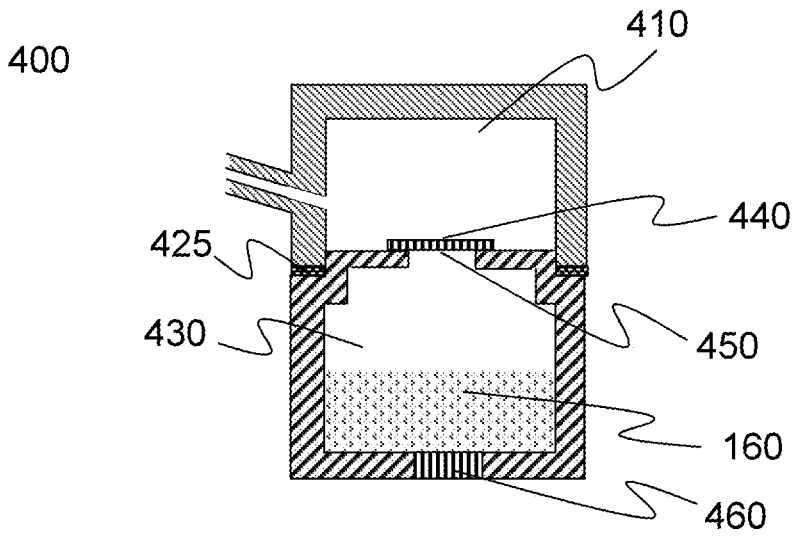
FIGS. 4A and 4B show the cross section views of a heating unit coupled with an air tight aerosol accumulation cavity according to one of the embodiments of the present disclosure.
Figure 4B:
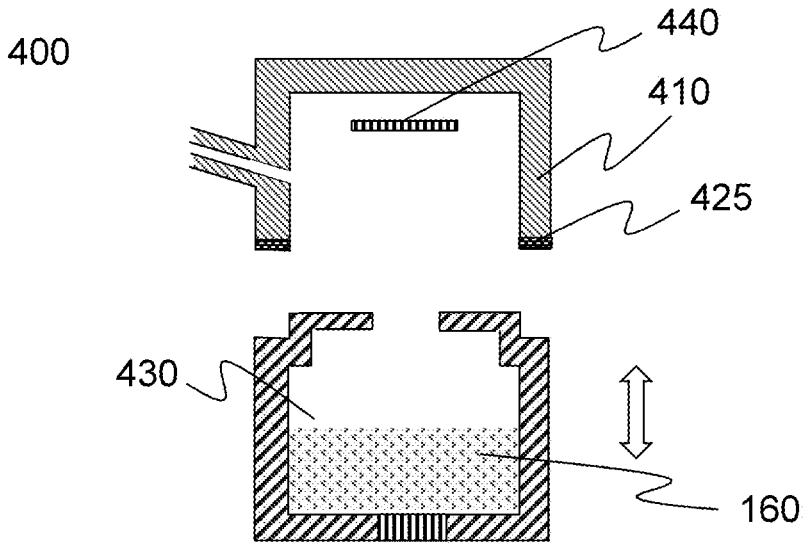

FIG. 4A and FIG. 4B show an alternative embodiment of the structure 400 of the heating unit 430 coupled to the air tight aerosol accumulation cavity 410. The heating unit 430 comprises one opening with a lid 440 and the heating unit is detachable from the aerosol accumulation cavity 410. Opening lid 440 allows the retrieved smoking substances to be fed into the heating unit when the heating unit is attached to the air tight aerosol accumulation cavity as shown in FIG. 4A. To ensure the aerosol accumulation cavity is air tight when attached, the connector of the heating unit is inserted into the connection receiver of the aerosol accumulation cavity with a sealing element 425. As shown in FIG. 4B, the heating unit can be unplugged and/or released from the air tight aerosol accumulation cavity. When the aerosol is consumed by a user, the heating unit can be released and the used smoking substances can be disposed from the heating unit.

With continued reference to FIGS. 4A and 4B, the lid 440 has through holes 450 to allow aerosol generated from the heating unit to be collected in the air tight accumulation cavity. Furthermore, a number of through holes 460 are arranged on the bottom of the heating unit for air supply.

The heating unit 230, 330, or 430 can be constructed by a ceramic enclosure. Ceramic material for the heating unit is chosen for its stability against erosion at an elevated temperature. In addition, ceramic enclosure facilitates uniform heating the smoking substance in the heating unit. In an alternative embodiment, the heating unit can be constructed by a metal enclosure.

Figure 5A:
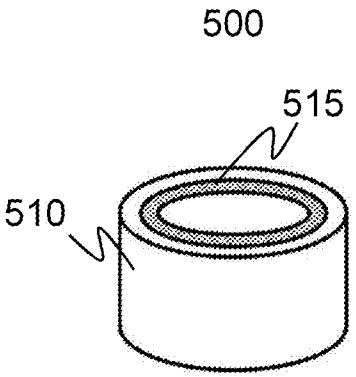
FIG. 5A-5D illustrates various embodiments of a heating unit of the electronic smoking device.
Figure 5B:
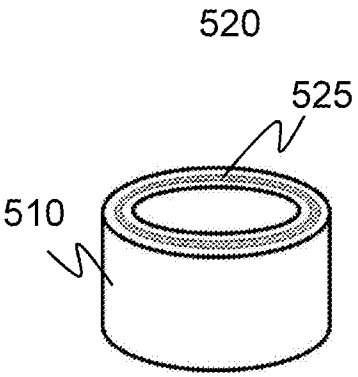
Figure 5C:
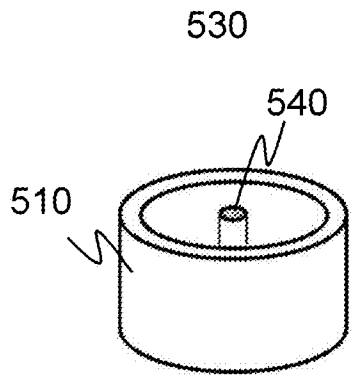
Figure 5D:
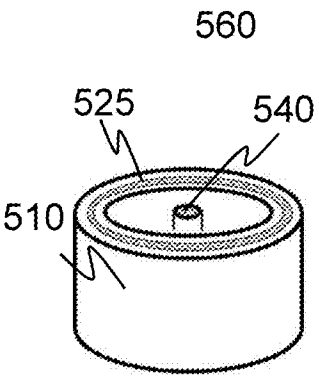

The heating unit 230, 330, or 430 comprises at least one electrical heating element configured to heat the smoking substance in the ceramic enclosure. FIG. 5A-5D illustrates various arrangements of heating element(s) in a heating unit 500, 520, 530, and 560 respectively. In one embodiment, a heating element is attached to the enclosure of the heating unit. For example, the heating element 515 can be coated on the inner surface of the enclosure 510 as shown in FIG. 5A. Alternatively, a heating element can be placed on the outside surface of the enclosure 510. Another example of attaching a heating element to the enclosure 510 is to embed the heating element 525 within the shell of the enclosure, as shown in FIG. 5B. In an alternative embodiment, a heating rod 540 can be inserted inside of the ceramic enclosure, as shown in FIG. 5C. In an alternative embodiment, the heating unit may have multiple heating elements attached to the ceramic enclosure as well as inside the enclosure, as shown in FIG. 5D. The heating element can be an electrical resistive heating element, an electromagnetic inductive heating element, or an infrared emitter. These types of heating elements are well known to those skilled in the art of heating element and need not be described in more detail herein.

Figure 6C:
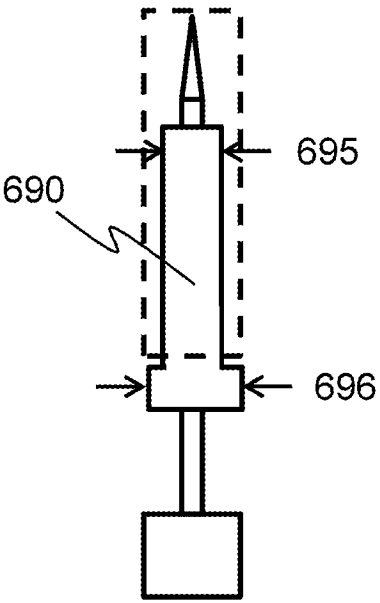
FIG. 6A-6C illustrates various embodiments of an extractor of the electronic smoking device.
Figure 6B:
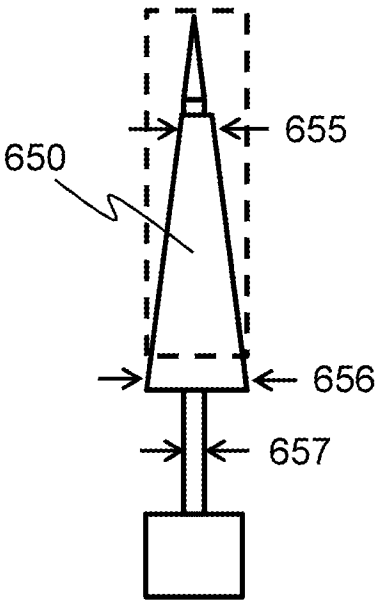
Figure 6A:
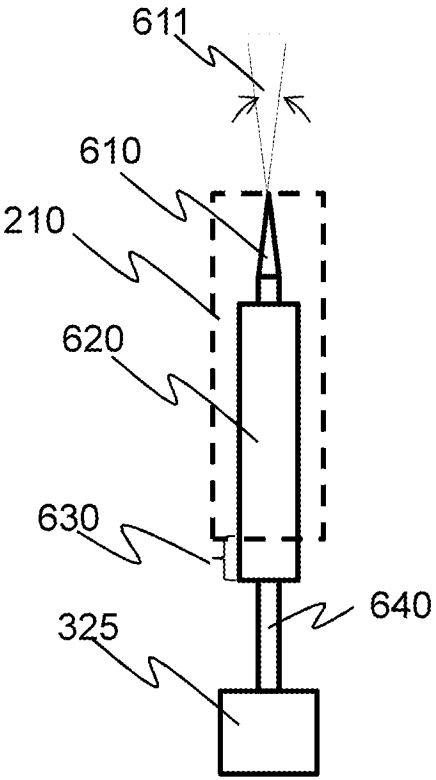

FIGS. 6A, 6B, and 6C illustrate various embodiments of the elongated portion of the extractor 320. As shown in FIG. 6A, the elongated portion of the extractor comprises a tip 610, a body 620 and a shank 640. In one embodiment, the tip has a sharp angle 611, preferably less than 60°. When a cigarette is inserted in the cigarette receiver 210 all the way down, the tip is punched into the cigarette filter 140 and anchored in the filter of the cigarette to stabilize the filter 140 of the mouthpiece.

With continued reference to FIG. 6A, the body 620 of the extractor provides a means for extracting smoking substances from a cigarette. As shown in FIG. 6A, the body extends its portion 630 beyond the bottom of the cigarette receiver to facilitate removing smoking substances from the cigarette and transferring the material to the heating chamber through the air tight aerosol accumulation cavity.

With continued reference to FIG. 6A, the driver 325 is coupled with the shank 640 to enable mechanical motion patterns of the elongated portion of the extractor. In one embodiment, the shank can be integrated with an electrical motor for an improved mechanical stability.

Referring to FIG. 6B and FIG. 6C, the diameter of the body of an extractor is not necessarily uniform. As shown in FIG. 6B, the diameter 655 is smaller near the tip and it gradually increases to a larger diameter 656 at the bottom of the body 650. For example, the range of the diameter 655 and 656 is 2-7 mm and 2-9 mm respectively. The diameter 656 is larger or equal to the diameter 655. In this example, the diameter of the shank 657 is 0.5-4 mm. In another embodiment, as shown in FIG. 6C, the diameter 695 of the body 690 inside the cigarette receiver 210 is uniform and the diameter 696 outside the cigarette receiver is enlarged. A purpose of enlarging the body diameter outside of the cigarette receiver is to facilitate an efficient retrieving and transferring the smoking substance from the cigarette to the heating unit.

Figure 7:
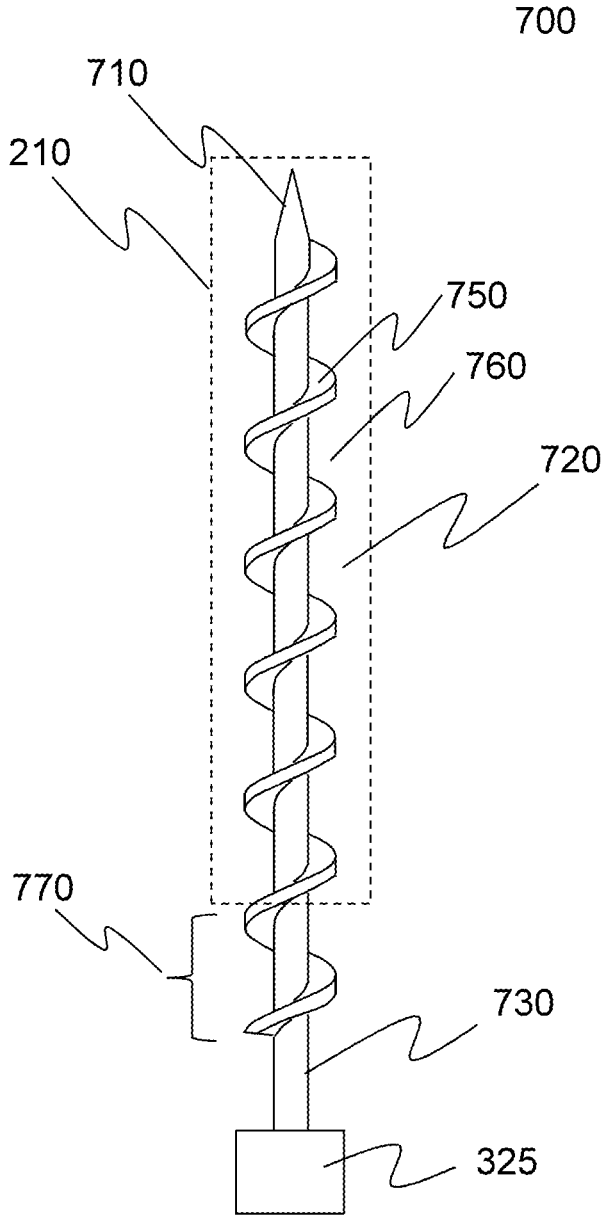
FIG. 7 illustrates an embodiment of an extractor of the electronic smoking device.

FIG. 7 shows an extractor 700 according to one embodiment of the present disclosure. The extractor comprises an elongated portion including a straight tip 710, a body 720, and a shank 730. The body 720 comprises a pair of a carving ridge 750 and a flute 760 having a downward angle and helically wrapped around the shank. When the body is rotating around the main axis, the carving ridge carves the packed smoking substance in a cigarette. The released materials are channeled by the flute and moving downward out of the cigarette, leaving the wrapping paper behind intact. As shown in FIG. 7, there is a portion of the body 770 that extends beyond the bottom of the cigarette receiver 210 to facilitate removing the released materials from the cigarette and to transfer them into the heating unit more efficiently. The length of the extended portion is at least one helix turn.

Figure 8A:
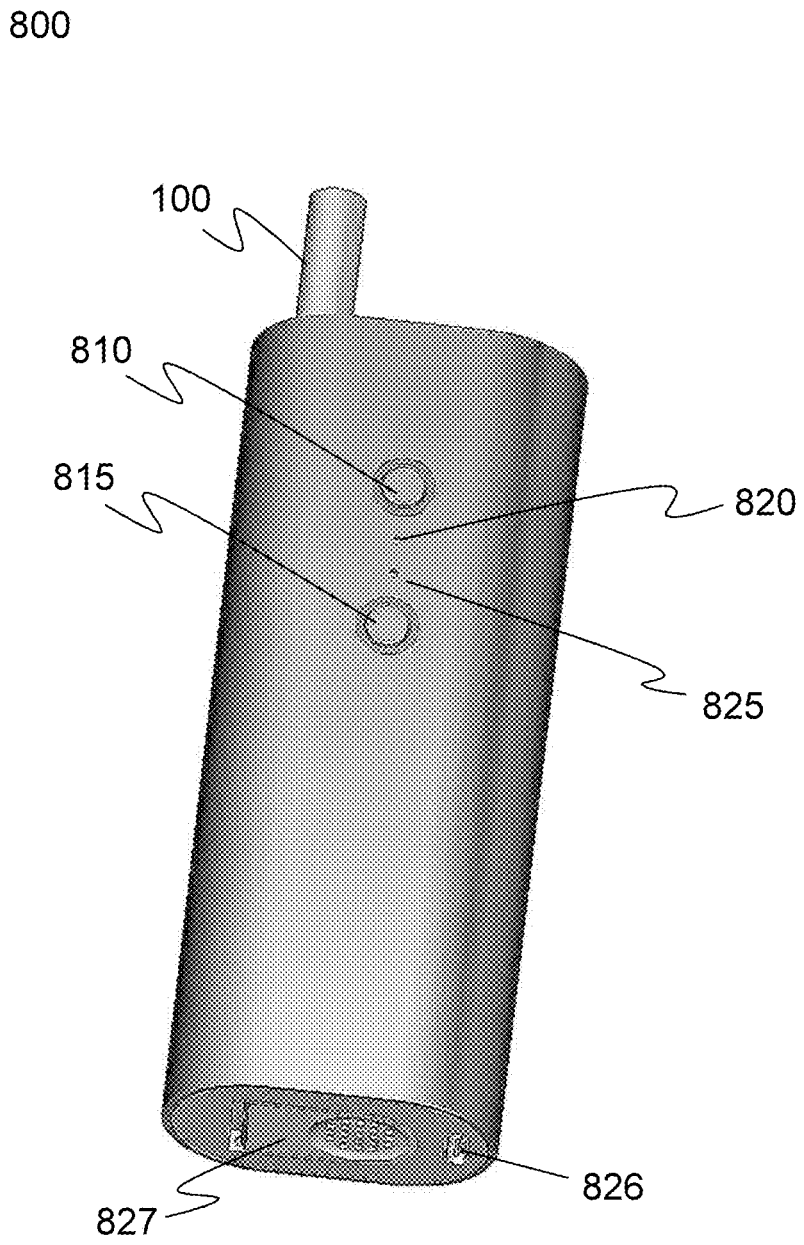
FIG. 8A-8C provides various views of an integrated electronic smoking device in according to one of the embodiments of the present disclosure.
Figure 8B:
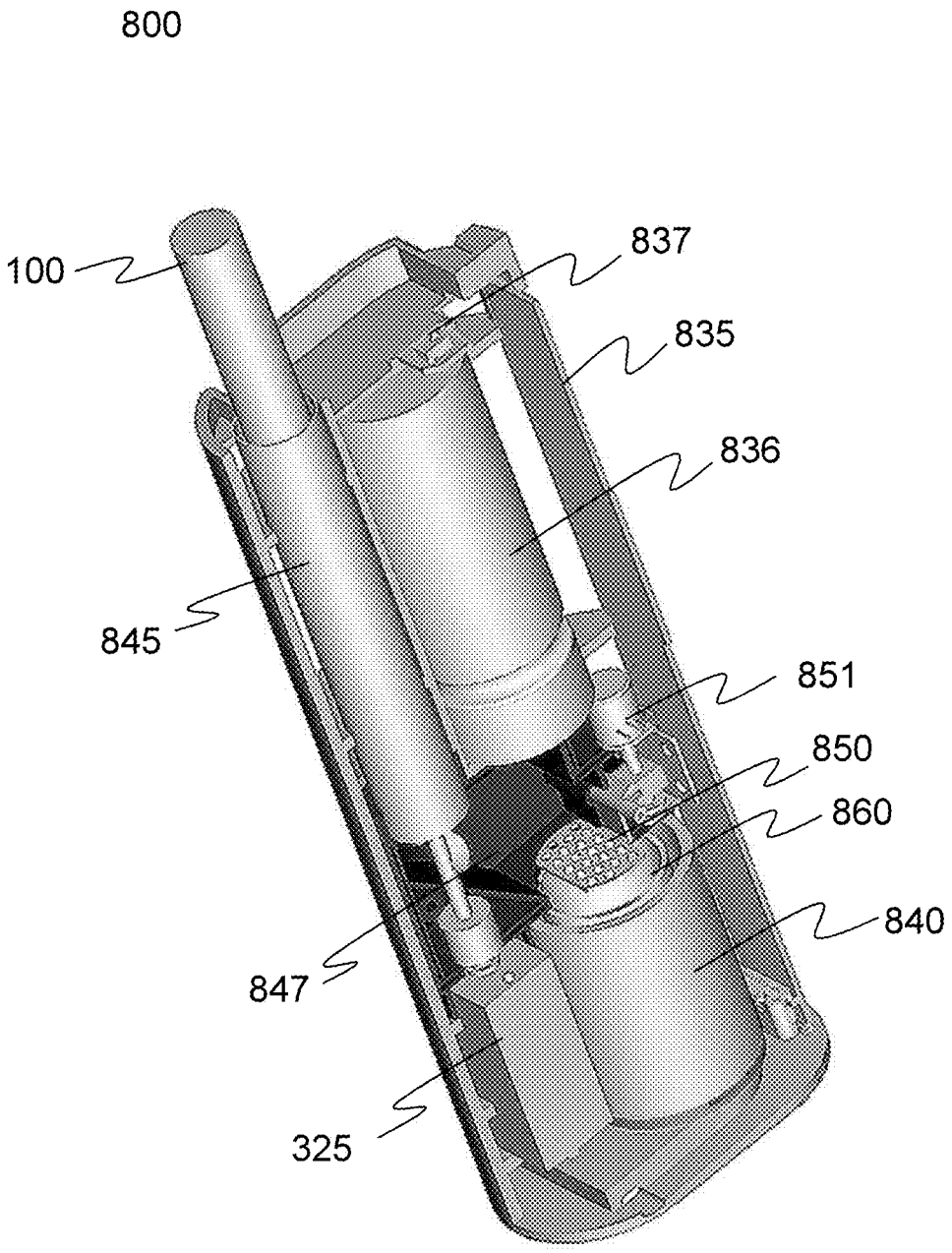
Figure 8C:
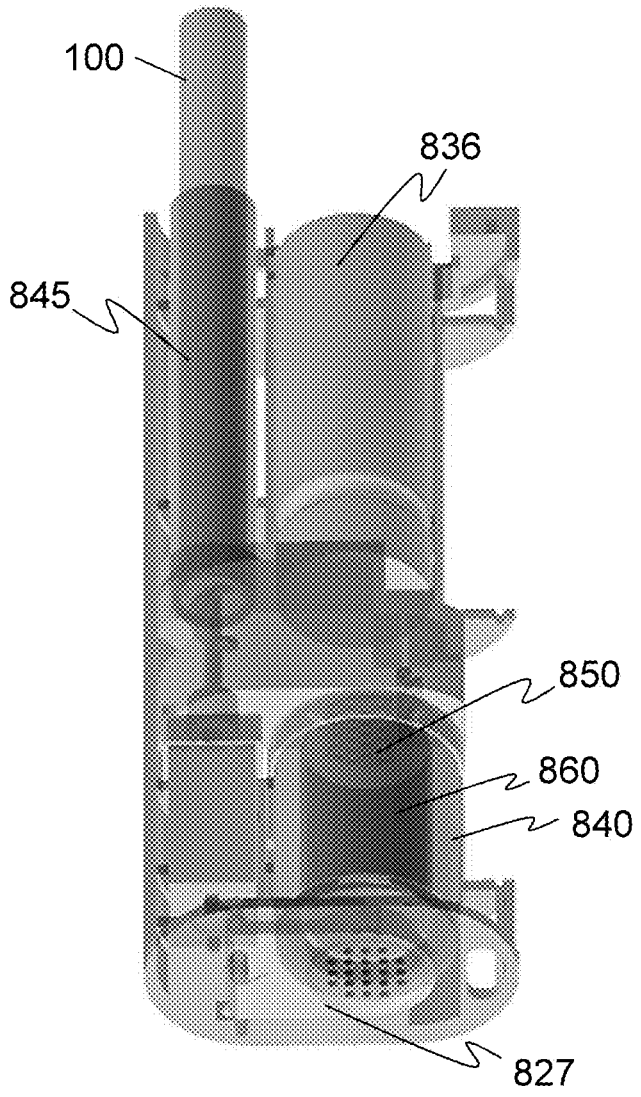

FIGS. 8A, 8B, and 8C illustrate a handheld electronic smoking device 800 according to one embodiment of the present disclosure. FIG. 8A shows an exterior view of the device 800 including button 810 and 815 as a user interface to increase or decrease the baking temperature for the smoking substance. From our experiments, it was found that the aerosol flavor varies correspondingly to the baking temperature. A sensitive user may optimize the flavor by adjusting the temperature with a user interface. FIG. 8A also shows LED indicators 820 and 825 to indicate device operation states and battery usage respectively.

FIG. 8B shows some components of device 800 under the cover. The components in the view include cigarette receiver 845, an air tight aerosol accumulation cavity 847, a cylindrical thermal insulator 840 enclosing a heating unit 860 with an operable lid 850, driver 851, electronic control circuit board 835, a rechargeable battery 836, and an on/off switch 837. The rechargeable battery can be charged via a charging plug 826 shown in FIG. 8A.

FIG. 8C shows a semi-transparent view of the inlet lid 850 and outlet lid 827 of the heating unit 860. It can be seen that lid 850 and 827 have a plurality of through holes for transferring generated aerosol to the air tight aerosol accumulation cavity 847 and for air supply to the heating unit respectively. The cylindrical shaped heating unit 860 is enclosed by the thermal insulator 840 to maintain an adequate temperature in the heating unit and to provide a comfortable temperature for a user to hold the smoking device.

In accordance with one embodiment of the present disclosure, the electronic control circuit board 835 can be coupled with a variety of types of user interfaces for device operation. Examples of the user interfaces include buttons, switches, or indicators. The circuit board provides various control functions including setting a desired temperature of the heating unit, managing extractor operation, and activating mechanical operations of the lids.

While examples and variations have been presented in the foregoing description, it should be understood that a vast number of variations exist, and these examples are merely representative, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described examples may be made without departing from the spirit and scope of the disclosure defined by the claims thereto.

What is claimed is:

1. An electronic smoking device, comprising:

a cylindrical cigarette receiver;

an extractor; wherein the extractor includes an elongated portion positioned within the cigarette receiver, with a body connected to a shank; the body comprises a pair of a carving ridge and a flute having a downward angle and helically wrapped around the shank to facilitate retrieving smoking substances and transferring them downward out of a cigarette;

a heating unit including at least one heating element for baking the retrieved smoking substances to generate a desired aerosol;

an air tight aerosol accumulation cavity with a sloped first opening air tightly coupled to the cigarette receiver and a second opening air tightly coupled to the heating unit;

an electronic control circuit board and a power supply.

2. The electronic smoking device of claim 1, wherein the shank is attached to a driver for enabling a motion pattern to facilitate retrieving the smoking substances from the cigarette; said motion pattern is selected from a group consisted of rotation around a main axis, longitudinal motion, vibration, or wobbling.

3. The electronic smoking device of claim 2, wherein the driver is an electric motor.

4. The electronic smoking device of claim 1, wherein the elongated portion further comprises a tip with an angle <60°; when the cigarette is fully inserted into the cigarette receiver, the tip is anchored onto a filter of the cigarette to stabilize a mouthpiece of the cigarette.

5. The electronic smoking device of claim 1, wherein the body of the extractor extends along a main axis beyond a bottom of the cigarette to facilitate transporting the retrieved smoking substances to the heating chamber through the air tight aerosol accumulation cavity.

6. The electronic smoking device of claim 1, wherein a range of the diameter of the body inside and outside of the cigarette receiver is 2-7 mm and 2-9 mm, respectively;

wherein the diameter of the body outside of the cigarette receiver is larger or equal to the diameter of the body inside of the cigarette receiver.

7. The electronic smoking device of claim 1, wherein the cylindrical cigarette receiver is designed to accommodate cigarettes with diameters in a range from 3 to 8 mm.

8. The electronic smoking device of claim 1, wherein the heating element is selected from a group consisting of an electrical resistive heating element, an electromagnetic inductive heating element, and infrared emitters.

9. The electronic smoking device of claim 1, wherein the heating element is attached to an enclosure of the heating unit.

10. The electronic smoking device of claim 1, wherein the heating element is placed inside of an enclosure of the heating unit.

11. The electronic smoking device of claim 1, wherein the heating unit is detachably attached to the second opening of the aerosol accumulation cavity; said heating unit has one opening with an operable lid for feeding the retrieved smoking substances to the heating unit when the lid is open and the heating unit is attached to the air tight aerosol accumulation cavity; said one opening allows for disposing used smoking substances when the heating unit is detached from the aerosol accumulation cavity.

12. The electronic smoking device of claim 1, wherein the cigarette receiver is air tightly coupled with the first opening of the air tight aerosol accumulation cavity with a slope; an angle between the slope and the main axis of the receiver is larger than 135°.

13. The electronic smoking device of claim 1 further comprising a thermal insulator enclosing the heating unit to maintain an adequate baking temperature for the retrieved smoking substance and to provide a comfortable temperature for a user to hold the smoking device.

14. The electronic smoking device of claim 1 further comprising user interfaces coupled to the electronic control circuit board to enable a user to control the temperature of the heating unit for an optimal smoking flavor.

15. The electronic smoking device of claim 1, wherein the heating unit includes an inlet and an outlet;

said inlet includes a first operable lid and is air tightly coupled to the air tight aerosol accumulation cavity, wherein when the first lid is open, the retrieved smoking substances move into the heating unit, and when the lid is closed the retrieved smoking substances are prevented from spilling out;

said outlet includes a second operable lid and is located on a bottom of the heating unit for disposing used materials.

16. The electronic smoking device of claim 15, wherein the lid of the inlet has a first set of through holes to allow the desired aerosol generated from the heating unit to be transferred to the air tight accumulation cavity and the lid of the outlet has a second set of through holes for air supply to the heating unit.

* * * * *